United States Patent [19]

Kaminski

[11] 3,973,091

[45] Aug. 3, 1976

[54] PUSHBUTTON KEYBOARD ASSEMBLY HAVING POLE AND INNER CONTACTS SIMULTANEOUSLY ENGAGED BY A BRIDGING CONTACT

[75] Inventor: Perry W. Kaminski, Norton, Mass.

[73] Assignee: Texas Instruments Incorporated, Dallas, Tex.

[22] Filed: Feb. 3, 1975

[21] Appl. No.: 546,466

[52] U.S. Cl. ..... 200/5 A; 200/159 B; 200/275

[51] Int. Cl.[2] ..... H01H 13/70; H01H 1/06

[58] Field of Search ..... 200/5 R, 5 A, 159 B, 200/243, 275, 302

[56] References Cited

UNITED STATES PATENTS

| | | | |
|---|---|---|---|
| 3,600,528 | 8/1971 | Leposauic | 200/159 B X |
| 3,684,842 | 8/1972 | Boulanger | 200/159 B X |
| 3,725,907 | 4/1973 | Boulanger | 200/159 BU X |
| 3,749,859 | 7/1973 | Webb et al. | 200/275 |
| 3,796,843 | 3/1974 | Durkee et al. | 200/5 A |
| 3,806,673 | 4/1974 | Boulanger | 200/159 B X |
| 3,808,384 | 4/1974 | Boulanger | 200/159 B X |

*Primary Examiner*—James R. Scott
*Attorney, Agent, or Firm*—John A. Haug; James P. McAndrews; Russell E. Baumann

[57] ABSTRACT

A keyboard system for an electronic pocket calculator, remote TV tuner or the like comprises a substrate board having a generally flat surface with a network of circuit paths thereon. The board is provided with switch contacts at a plurality of switching stations. The switch contacts comprise at least one inner and outer contact for each switch station with the top surface of the outer contact spaced from the substrate a greater distance than the top surface of the inner contact. A switch actuating electrically conductive disc is placed over each switch station and is resiliently deformable into a position in which the disc bridges the outer and inner contacts to thereby complete a circuit therebetwen. In several embodiments switching stations are shown comprising an outer contact on which the outer margin of the electrically conductive disc is in contact both in the actuated and unactuated position while other embodiments comprise a disc support whch maintains the disc out of contact with both the outer and inner contacts in the unactuated position. The latter arrangement is particularly useful in providing multipole switching stations. A sheet of flexible insulative material may be adhesively bonded to the keyboard and to the outer faces of the discs for securing the discs in position relative to their respective contact portions for permitting the discs to be deformed to their actuated positions and for sealing the discs to the board.

11 Claims, 13 Drawing Figures

PUSHBUTTON KEYBOARD ASSEMBLY HAVING POLE AND INNER CONTACTS SIMULTANEOUSLY ENGAGED BY A BRIDGING CONTACT

This application includes subject matter disclosed in patent application Ser. No. 535,468, filed Jan. 10, 1975.

BACKGROUND OF THE INVENTION

This invention relates to a manual pushbutton keyboard system for an electronic pocket calculator, a remote TV tuner, a pushbutton telephone, or for other electrical or electronic appliances, and it is particularly concerned with such a keyboard which utilizes dished or domed discs as switch actuating elements of single-throw (ST) momentary switches for the keyboard.

More generally, calculator keyboards conventionally include a plurality of ST momentary switches and a network of conductor paths on a printed circuit board leading to terminals at one margin of the board for connection of the keyboard switches to other electronic components, such as to various solid state, integrated circuit, and semi-conductor logic components within a calculator. Prior art keyboards, such as shown in the coassigned U.S. Pat. Nos. 3,684,842; 3,806,673 and 3,808,384, utilized domed discs as switch actuating elements. Use of such doomed discs is desirable for various reasons including the tactile feedback the disc gives the operator when the disc suddenly moves from an unactuated position to an actuated position. As disclosed in the last two mentioned patents such discs are utilized with both single and multipole switches and generally comprise an electrically conductive disc supported at or near its outer margins by an outer contact. Since the disc is formed with a concave configuration in its unactuated condition (facing the contacts) it is held out of touch with one or more inner contacts disposed beneath the disc. As the disc is actuated by an operator depressing a key the configuration of the disc changes with the center moving to or below the plane formed by its outer periphery until the disc touches the inner contacts thereby establishing a circuit between the outer and inner contacts through the disc. Although this approach is effective with the plurality of poles of a given switching station being energized at essentially the same moment, there are certain applications in which it is desirable to preclude the possibility of one pole being energized slightly before another one at the same switching station.

SUMMARY OF THE INVENTION

Among the many objects of this invention may be noted the provision of a keyboard system which requires a minimal number of parts; the provision of such a keyboard system in which the switching stations may comprise single or multipole switches; the provision of such a keyboard system having multipole switching stations in which the poles are inherently switched simultaneously; and the provision of such a keyboard which is inexpensive to manufacture and easy to assemble. Other objects and features of this invention will be in part apparent and in part pointed out hereinafter.

Briefly, a keyboard system of this invention includes a substrate keyboard having a generally flat surface with a network of circuit paths thereon. The board may be metallic with a dielectric layer thereon on which the circuit paths are disposed or it may be a conventional electrically insulative substrate. In any event, switch contacts are provided at a plurality of switching stations on the substrate and are interconnected by conductive paths. The network of circuit paths also provide interconnection with terminals. The switch contacts comprise at least one inner and outer contact for each switch station with the top surface of the outer contact spaced from the substrate a greater distance than the top surface of the inner contact. A switch actuating electrically conductive disc is placed over each switch station and is resiliently deformable between an initial position in which it is clear of the inner contact and an actuated position in which the disc bridges the outer and inner contacts to thereby complete a circuit therebetween. Switching stations comprise a disc support which may be one or more pads, generally U-shaped staple like elements or an apertured insulative layer of material adapted to support the outer margin of the disc. The support maintains the disc out of contact with both the outer and inner contacts in the unactuated position. The pole contacts comprise the outer contacts of the switching station and are disposed intermediate the inner contact and the disc support. A sheet of flexible insulative material may be adhesively bonded to the keyboard and to the outer faces of the discs for securing the discs in position relative to their respective contact positions, for permitting the discs to be deformed to their actuated position, and for sealing the discs to the board.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
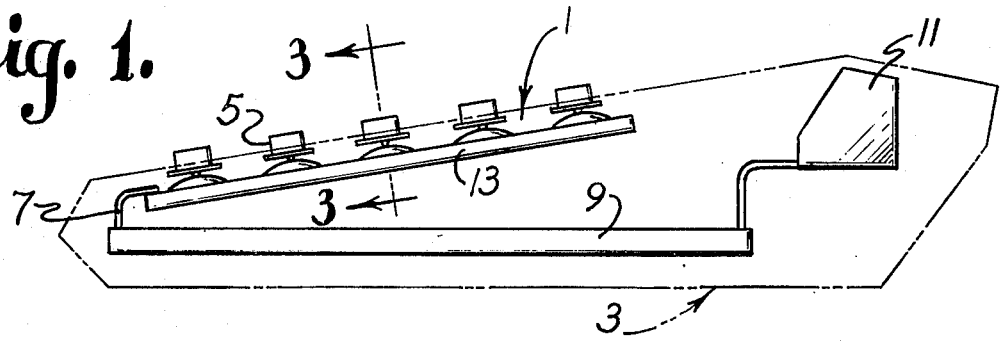
FIG. 1 is a side elevational view of a pocket calculator in which the major components of the calculator including its case, its display module, and its motherboard carrying various electronic logic components (not shown) are illustrated and in which a keyboard system of the invention is installed.

Referring now to the drawings, a keyboard system of this invention, indicated in its entirety at 1, is shown in FIG. 1 installed in an electronic pocket calculator 3. The keyboard system is actuated by manually operable pushbuttons 5 and is electrically connected by umbilical connectors 7 to other electrical or electronic components, such as solid state logic components (not shown) on a motherboard 9 within the calculator. The calculator displays its output on a light-emitting diode (LED) display module 11. The power supply for the calculator is not shown.

More particularly, keyboard system 1 comprises a substrate board 13 which has a relatively flat surface. Substrate 13 may be a metallic substrate with a dielectric layer thereon such as a steel sheet 15 having a porcelain enamel layer 17 thereon. Alternatively an anodized aluminum sheet may be used or a conventional electrically insulative laminated circuit board. On top of dielectric layer 17 (or the insulative laminated circuit board, if used) a network of circuit paths 19 may be formed in any conventional manner interconnecting terminals 21 with various switch stations 23. A switch actuating element 25 is provided at each station 23. These elements are shown to be concave-convex dome discs of a resilient, electrically conductive material, such as stainless steel, phosphor bronze or the like, having a convex outer face and a concave inner face. As generally indicated at 27 in FIG. 2, so-called conductor means are provided on board 13. Conductor means 27 includes switch contact means 29 at each switch station, terminal means 21 at one margin of board 13 for electrical interconnection to umbilical connectors 7, circuit paths 19 on enamel layer 17 and conductive paths 31 interconnecting various switch contact means 29 and the circuit paths 19.

Contact means 29 includes an outer contact portion 35 on the surface of a dielectric layer 37. Dielectric layer 37 is formed with an array of apertures 39 in which is located inner contact portion 41 of contact means 29. The outer contact portions 35 are connected to terminal means 21 via conductor paths 31 and circuit path network 19 through one or more apertures 49 in dielectric layer 37 and the inner contact portion 41 are connected to terminal means 21 via conductor path 33 of circuit path network 19.

Discs 25 are resiliently deformable from an initial position in which the outer margin of the disc is in engagement with its respective outer contact portion surface 35 and in which it is clear of its respective inner contact portion surface 41 and an overcentered actuated position (see FIG. 5) in which a point on its initially concave face (i.e., its center) contacts its inner contact portion surface 41 thereby to complete a circuit between contact surfaces 35 and 41.

A sheet of 43 of insulative material such as polyethylene terephthalate, commercially available under the trade designation MYLAR from the E.I. du Pont de Nemours and Company, it adhesively bonded (as by a coating of pressure-sensitive adhesive applied to one face of the sheet) to one face of board 13 and to the outer or initially convex faces of discs 25. Thus, sheet 43 secures the discs in position on the board relative to their respective contact portions, permits the discs to be deformed to their overcentered actuated positions, and seals the discs to the board so as to prevent dirt or other contaminates from lodging in the recesses between the discs and the contact portion surfaces which may deleteriously affect operation of the keyboard system.

Figure 2:
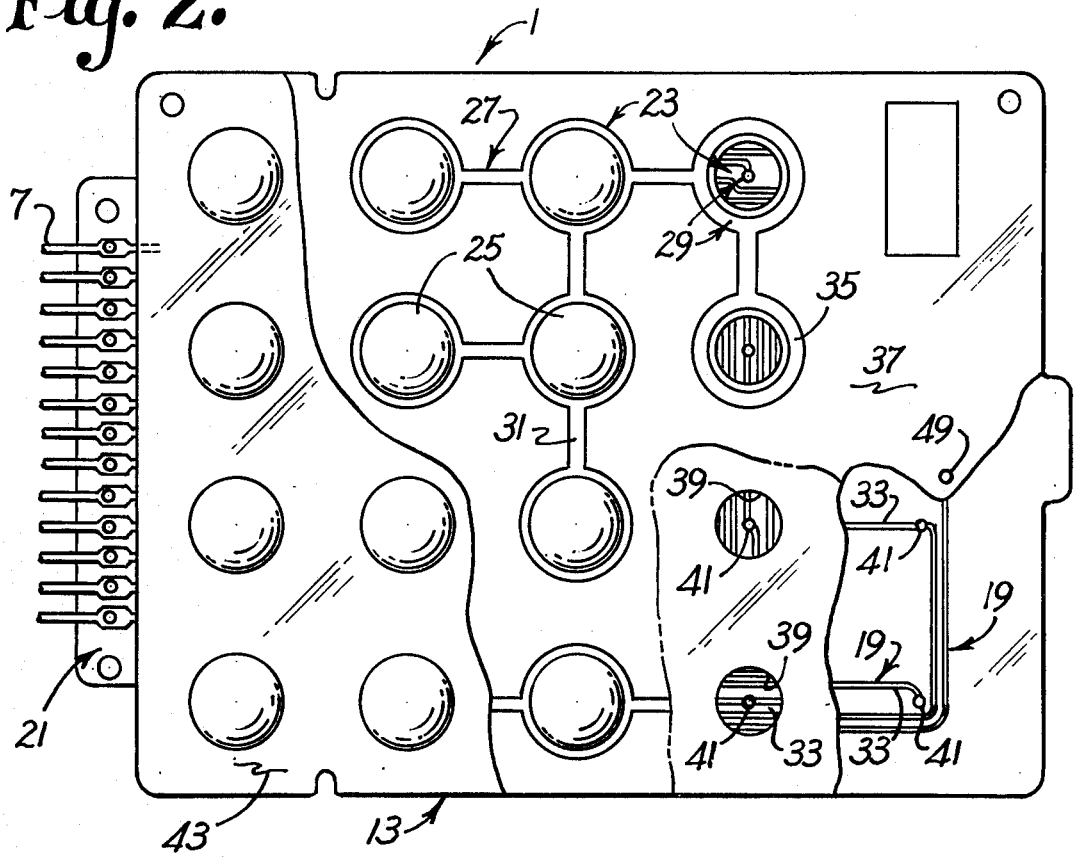
FIG. 2 is an enlarged plan view of the keyboard system with some parts broken away for clarity.
Figure 3:
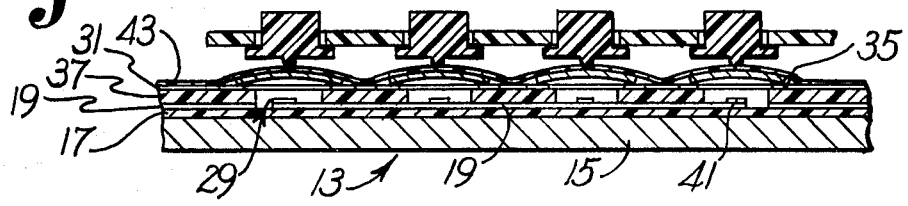
FIG. 3 is an enlarged section taken on line 3-3 of FIG. 1.

As best shown in FIG. 2 and 3 a substrate 15 having a flat surface and a dielectric layer thereon is provided with a network of circuit paths 19. A relatively thick layer 37 of dielectric material of devitrifying glass, recrystallizing glass, thermosetting resin or other suitable material is placed on top of board 13 again preferably by screen printing so that the top surface of layer 37 is spaced at a selected height above the substrate. Layer 37 is provided with an array of apertures 39 each aligned with a portion of conductive paths 33 of network 19 to thereby expose the top surface thereof. On top of selected portions of circuit paths 19, in particular on conductive paths 33, a plurality of inner contact portions 41 are applied as by screen printing. Portions 41 as well as network 19 may comprise a conventional glass-frit based nickel, copper, gold or silver or a molecular bond frittless silver, gold, or other suitable conducting material which can be screen printed onto the substrate. At the same time and composed of the same materials as that used for the inner contact portion 41, electrically conductive outer contact portion 35, preferably generally annular in configuration, and, conductor paths 31 joining contact portion 35 are applied. The conductive material also extends through at least one aperture 49 into contact with network 19.

The difference in the distance from the substrate to contact portion 35 and 41 is relatively small compared to the domed height of discs 25. For example, discs 25 may have a domed height of 0.010 inch (0.25 mm) and the difference in the two distances may be between 0.003 – 0.004 and (0.08 – 0.10 mm). Disc 25 has a diameter intermediate the inner and outer diameter of outer contact annular portion 35 so that the outer margin of the disc is supported on the outer contact portion surface 35 of a selected distance above the inner contact portion 41. As described, inner contact portion 41 has a top surface above conductor paths 33 and dielectric layer 17 forming a moat which serves as a reservoir into which dust particles and other solid contaminates may be received so as to prevent these contaminates from lodging on the upper surface of inner contact portion 41 where they could prevent electrical contact between discs 25 and the inner contact upon the disc being moved to its overcentered position.

As stated above, outer contact portion 35 is shown to be annular in shape while discs 25 are generally circular in plan and of dish-shaped cross-section having a double curved outer surface, such as a segment of a spheroid, and having a generally convex upper surface of curvature when they are in their initial or rest position, this convex surface being engageable by tits 53 on pushbutton keys 5. The disc has an overcentered actuated position when its center portion is subjected to a preselected deflecting force and it automatically returns to its initial position upon removal of the deflecting force, thereby the element has a mechanical memory to return to its initial position. Of course, these actuating elements may have shapes other than those shown and described herein. Preferably, the disc undergoes a sudden deflection from its initial to its overcentered actuated position as it establishes electrical contact with its respective inner contact portion 41. As a result of this sudden deflection, tactile feedback is provided to the operator depressing the key which may be sensed in the fingertips. Furthermore, this sudden overcentering may provide an audible signal thus indicating the pushbutton has been properly depressed to generate the desired electrical signal. It will be noted that due to the difference in height between the inner and outer contact portion the center of the disc is able to move below its outer margin by about 0.003 – 0.004 inch (0.08 – 0.10 mm) providing for the desired tactile feedback effect.

Contact portions 35, 41 and dielectric layer 37 may be applied by a conventional thick film screen printing process as used for instance in the field of hybrid microelectronics as a convenient way to apply such layers as well as to obtain the desired height differential between the contact surfaces. A low temperature system is preferred but is not essential. For more details on such typical processes reference may be had to *Thick Film Hybrid Microcircuit Technology* by Donald W. Hamer and James V. Biggers, published in 1972 by Wiley-Interscience of New York, for example, chapter 2, pages 29–55.

In assembling the above described keyboard system, the requisite number of discs 25 (e.g., 18 discs are required for the keyboard shown in FIG. 1), are arranged in a fixture (not shown), either by hand or by automatic vibratory feed equipment with their concave faces down to correspond to the location of the switch stations 23 on board 13. Insulative sheet 43 with a continuous layer of adhesive material on its under surface is then placed on the fixture and the outer convex faces of the discs are adhesively gripped by the sheet. The sheet with the discs adhesively held thereby is then bonded to the face of substrate board 13 which has been previously screen printed to form contact surface portions 35, 41 and conductor paths 31. It should be noted that network 19 may also be screen printed. Thus, all of the discs on the sheet are simultaneously positioned relative to their respective contact portions and secured in place by adhering sheet 43 to the board 13. Of course, if desired, another dielectric layer may be placed on top of layer 37 formed with apertures therein having a diameter approximately the same as the outer diameter of contact portion 35 and aligned therewith and thus provide seats for discs 25.

In the FIG. 2, 3 embodiment the switch stations are shown to have conductor paths 33 connecting the inner contact portions 41 which are covered by dielectric material while conductor paths 31 connecting outer contact portions 35 are generally coplanar with portions 35.

Figure 4:
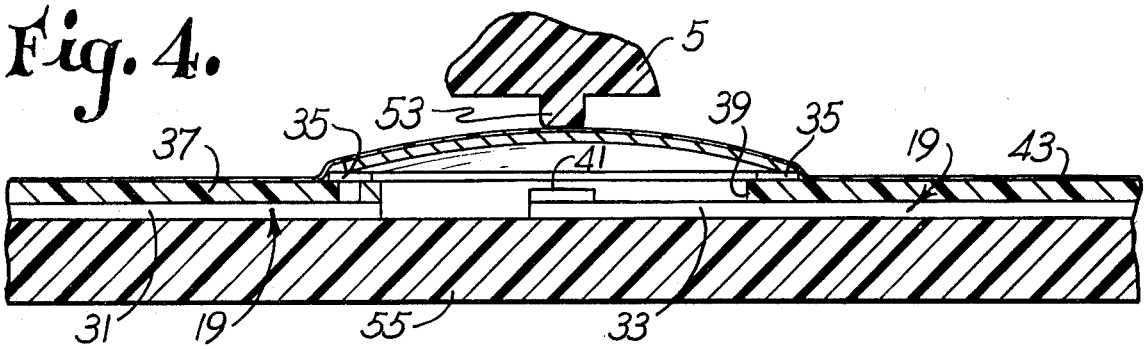
FIG. 4 is a cross-section illustrating details of a switching station modified slightly from that shown in FIGS. 2 and 3 and showing an actuating element in its initial convex position.
Figure 5:
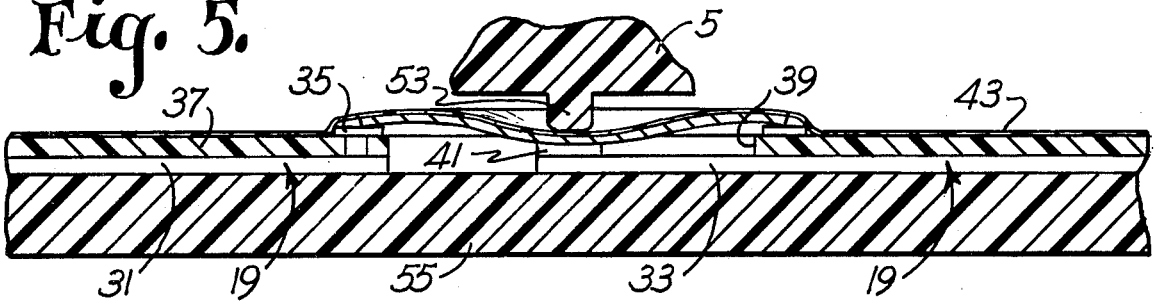
FIG. 5 is a view similar to FIG. 4 illustrating the actuating element in its overcentered actuated position.

FIGS. 4 and 5 show a modification of this arrangement in which both conductive paths 31 and 33 are covered by dielectric layer 37. FIGS. 4 and 5 also depict an arrangement in which the switching station is disposed on an insulative substrate 55 which may be a conventional laminated circuit board having a circuit path network thereon.

Figure 6:
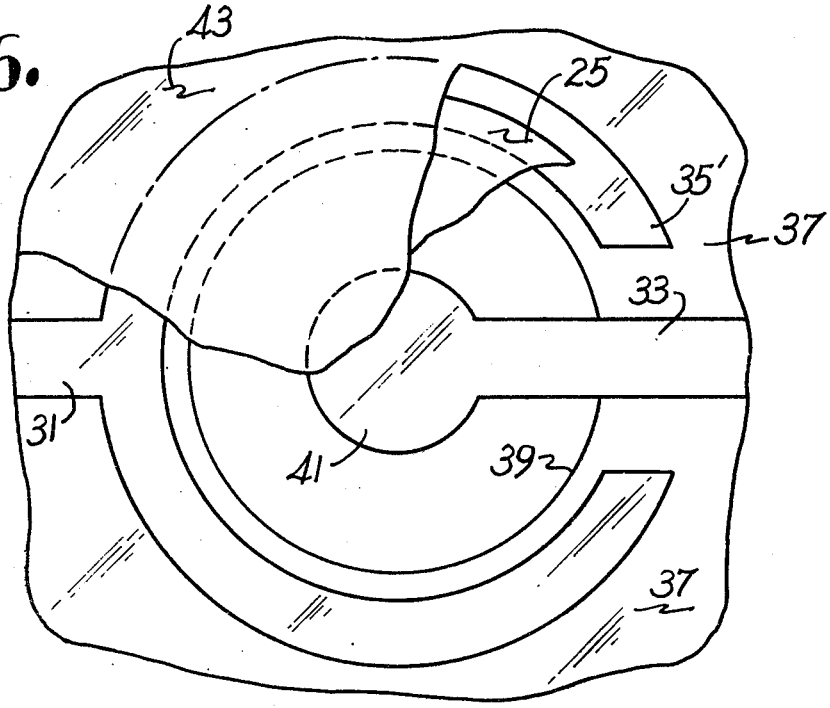
FIG. 6 is an enlarged plan view of a portion of the substrate board illustrating one switch station of a form slightly modified from that shown in FIGS. 4 and 5 with parts broken away for clarity.

FIG. 6 shows yet another modification in which both conductive paths 31 and 33 are disposed on top of dielectric layer 27. In this arrangement outer contact portion 35 is in the form of a partial or broken annular ring forming a gap in the outer contact portion to allow conductor path 33 to pass through the gap.

Figure 7:
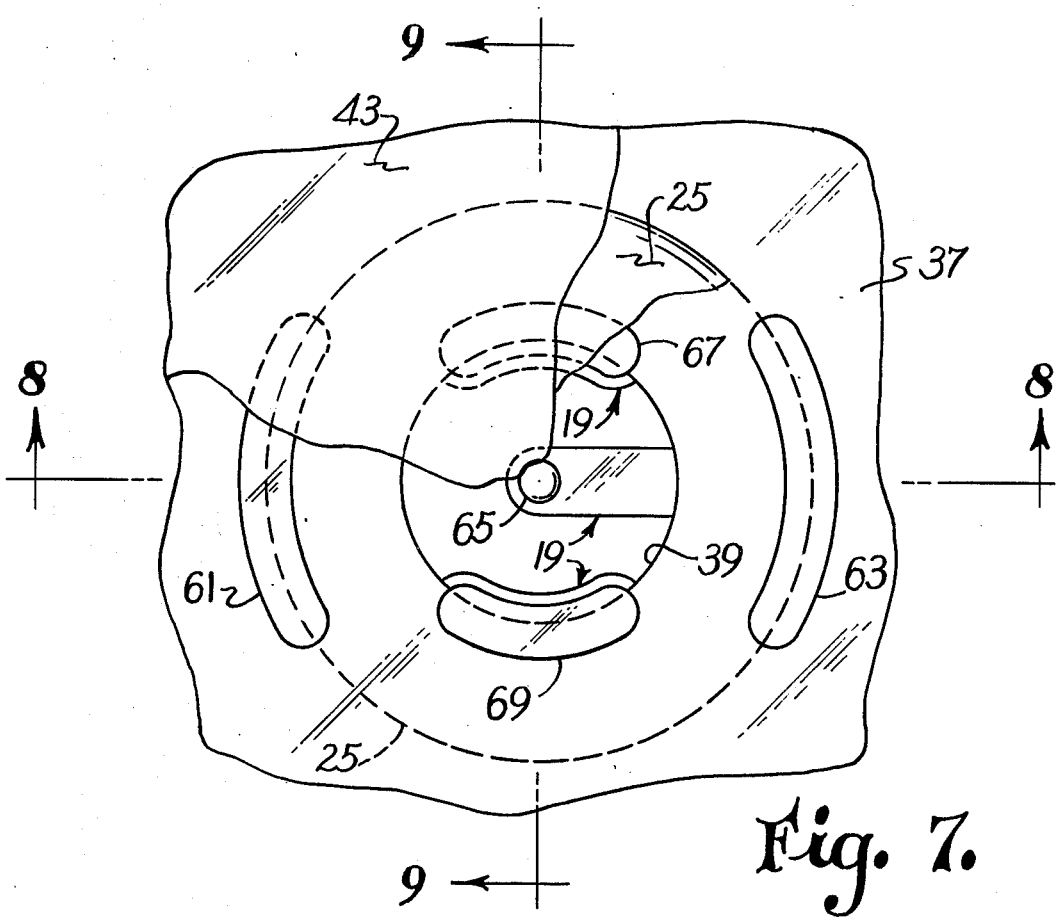
FIG. 7 is a top plan view similar to FIG. 6 of a first multipole embodiment according to the invention.
Figure 8:
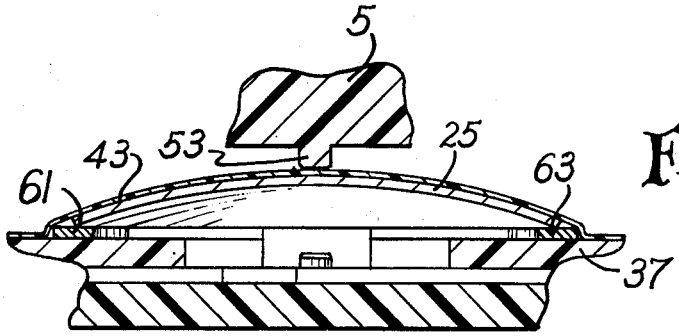
FIG. 8 is a cross-sectional view taken on lines 8--8 of FIG. 7 with the disc in the unactuated position.
Figure 9:
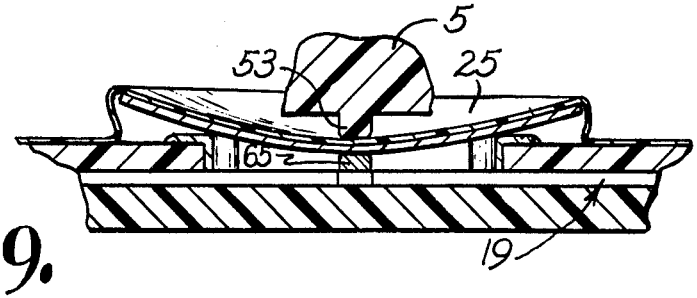
FIG. 9 is a cross-sectional view taken on lines 9--9 of FIG. 7 with the disc in the actuated position.

In certain applications it is desirable to provide multipole switching for some or all the keys in which switching of the poles is accomplished simultaneously. FIGS. 7–13 show several embodiments which provide such switching. With reference to FIGS. 7–9 pads 61, 63 are disposed on dielectric layer 37 so that the pads support the outer margin of disc 25 above the top surface of layer 37. An inner contact 65 is disposed on a selected portion of circuit network 19 within an aperture 39 of layer 37. Outer pole contacts 67, 69 are located radially intermediate center contact 65 and support pads 61, 63 in electrical connection with other selected portions of circuit network 19. The support pads, outer and inner contacts may conveniently be formed of the same electrically conductive material as used for the contact portions in the FIG. 2–6 embodiments and may be screened onto the substrate in a single operation. Since support pads 61, 63 are disposed on dielectric layer 37 they are not interconnected with circuit network 19. If desired a single annular support pad could be used. In operation, in the unactuated state as seen in FIG. 8 disc 25 is supported on its outer margin or periphery above the top surface of layer 37 so that the disc is out of touch with both inner contact 65 and outer pole contacts 67, 69. Upon depression of key 5 the center of disc 25 will move through the plane formed by its outer periphery making contact first with the two pole contacts 67, 69 and then with inner contact 65. Thus, since both pole contacts are in engagement with disc 25 prior to the time that the disc engages inner contact 65 bridging electrical connection between the inner energizing contact and the two pole contacts is effected inherently simultaneously. It will be noted that the outer peripheral margin of disc 25 is lifted off the supports during actuation of the disc. The outer contacts as well as the support pads are arc shaped to allow for some displacement of a disc without affecting operation of the switching station.

Figure 10:
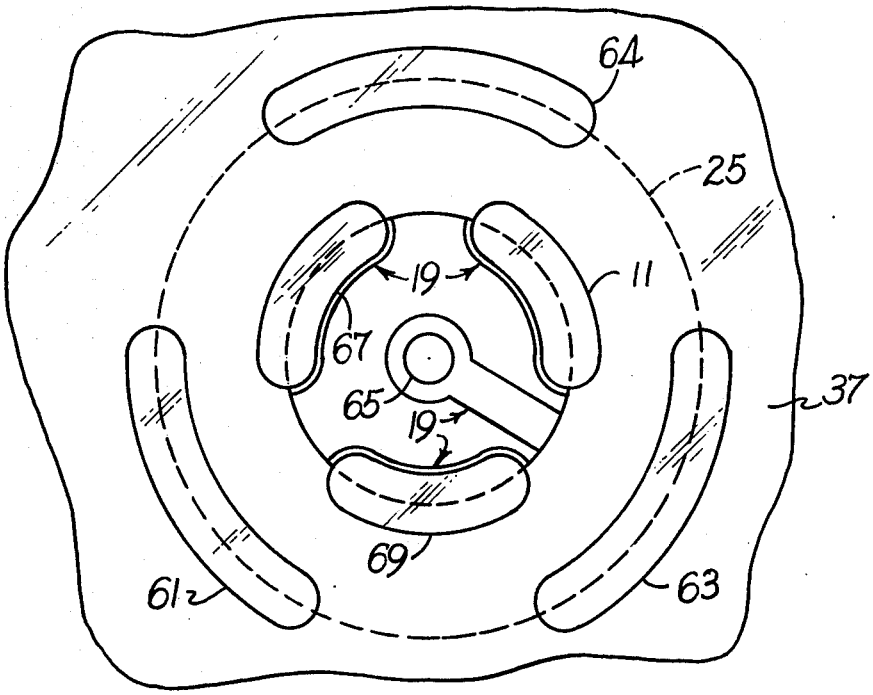
FIG. 10 is a top plan view similar to FIG. 7 of another multipole embodiment according to the invention.

In FIG. 10 a modification of the FIG. 7–9 embodiment is shown in which three pole pieces 67, 69 and 71 are provided in electrical connection with selected portions of circuit network 19. Also provided are three support pads 61, 63 and 64 although the particular number of support pads is a matter of choice as long as disc 25 is supported with its outer peripheral edges in a plane generally parallel with layer 37.

Figure 11:
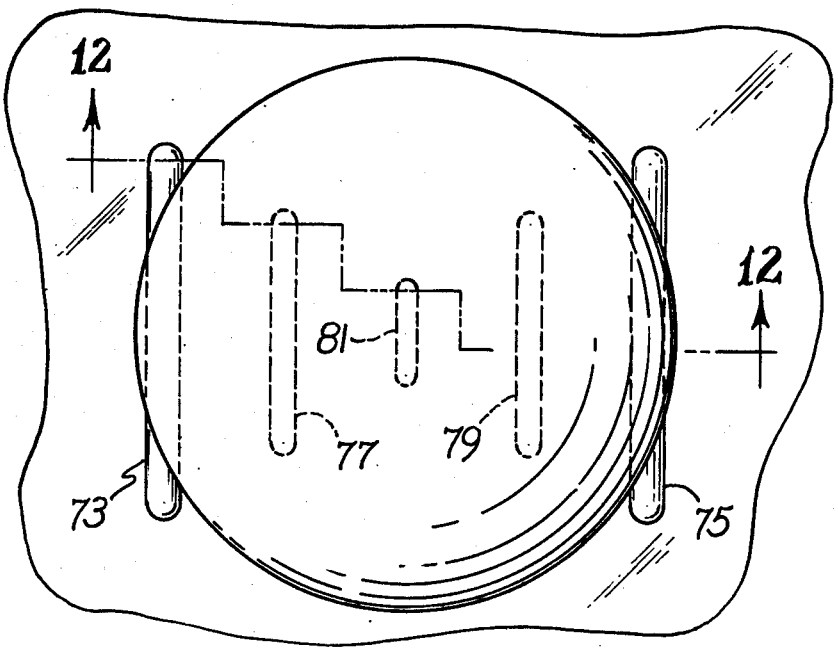
FIG. 11 is a top plan view similar to FIG. 10 of yet another multipole embodiment according to the invention.
Figure 12:
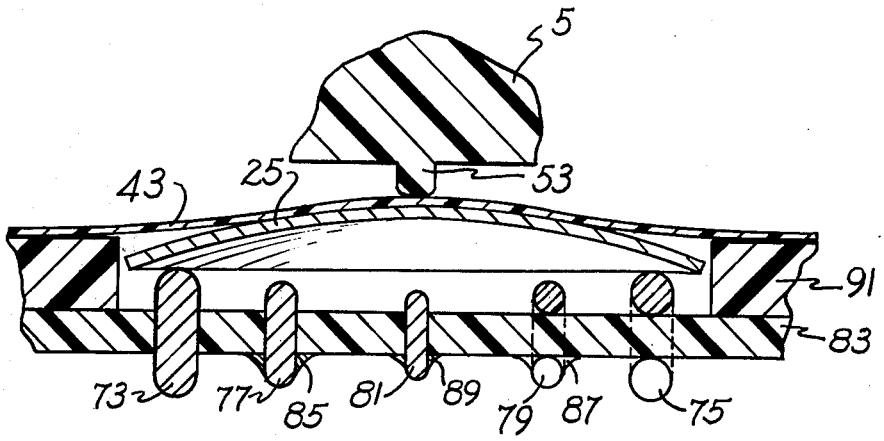
FIG. 12 is a cross-sectional view taken on lines 12—12 of FIG. 11.
Figure 13:
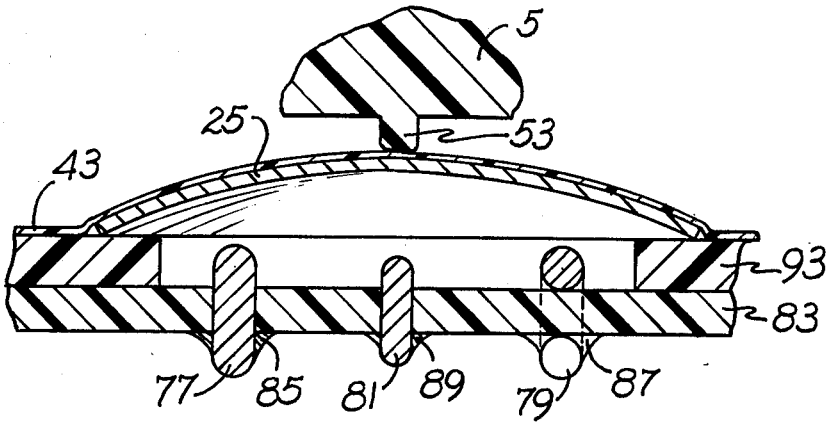
FIG. 13 is a cross-sectional view similar to FIG. 12 of another multipole embodiment according to the invention.

Although the above multipole embodiments are easily constructed using thick film screen printing techniques described above the same functional effect can be provided by using other types of supports and contact elements. As seen in FIG. 11 and 12 for instance support members 73, 75 as well as outer pole contacts 77, 79 and inner contact 81 may be formed of generally U-shaped staple like wire elements having a bight portion and two legs depending from opposite ends thereof. In order to achieve a difference in height among the sets of staples to optimize tactile feedback as described above in connection with the FIGS. 2-6 embodiments progressively smaller diameter round wire may be used for the outer pole contact staples 77, 79 compared to the support staple 73, 75 and for the inner contact staple 81 compared to the outer pole contact staple 77, 79. Alternatively, the support and outer pole contact staples may be of the same size with inner contact 81 made from a smaller diameter wire to obtain desired tactile feedback. As seen in FIG. 12 pole contacts 77, 79 and inner contact 81 are electrically connected respectively at 85, 87, 89 as by soldering to selected portions of a circuit (not shown) on the lower side of a standard circuit board substrate 83. Insulation sheet 43 with adhesive material on its lower surface may be relied on to maintain discs 25 in their correct location; however, when staples are employed to support the discs 25, a disc retainer 91, also of insulative material, is preferred. FIG. 13 shows a modification of the FIG. 11, 12 embodiment in which a layer 93 of insulative material is used to support disc 25 out of contact with outerpole contacts 77, 79 and inner contact 81 when in the unactuated position.

In view of the above, it will be seen that several objects of the invention are achieved and other advantageous results attained.

As various changes could be made in the above constructions without departing from the scope of the invention, it is intended that all matter contained in the above-description or shown in the accompanying drawings shall be interpreted as illustrative and not in a limiting sense.

I claim:

1. A keyboard system comprising a generally flat substrate, a plurality of switching stations provided on the substrate, each switching station comprising an electrically conductive disc, the disc having an unactuated and an actuated configuration and having an outer peripheral margin, electrically isolated support means for supporting the outer peripheral margin of the disc when in the unactuated configuration, an inner contact disposed on the substrate generally beneath the center of the disc but out of contact with the disc when in the unactuated configuration, at least two outer pole contacts disposed on the substrate radially intermediate the support means and the inner contact, the pole contacts out of contact with the disc when in the unactuated configuration, the pole contacts located relative to the inner contact so that upon actuation the disc engages the pole contacts prior to the inner contact whereby electrical connection of each pole contact with the inner contact occurs simultaneously.

2. A keyboard system according to claim 1 in which the pole contacts have a top surface spaced from the substrate a distance greater than a top surface of the inner contact.

3. A keyboard system according to claim 1 in which the support means includes a plurality of arc shaped pads.

4. A keyboard system according to claim 3 in which the pole contacts are arc shaped pads of electrically conductive material.

5. A keyboard system according to claim 4 in which there are two pole contacts disposed on two opposite sides of the inner contact.

6. A keyboard system according to claim 4 in which there are three pole contacts evenly spaced around the inner contact.

7. A keyboard system according to claim 2 in which the discs are generally circular-in-plan having a selected diameter and the support means is a layer of electrically insulative material, the layer having a plurality of apertures with a diameter slightly smaller than the selected diameter of each respective disc.

8. A keyboard system according to claim 2 in which the support means includes two spaced generally U-shaped elements each having two legs depending from a bight portion, the substrate being provided with a plurality of pairs of apertures, the depending legs of the elements received in a pair of apertures so that the disc is received on the two bights.

9. A keyboard system according to claim 8 in which the outer pole contacts include two spaced generally U-shaped elements each having two legs depending from a bight portion, the depending legs of each outer contact element received in a respective pair of apertures.

10. A keyboard system according to claim 9 in which the inner contact includes a single generally U-shaped element having two legs depending from a bight portion, the depending legs of the inner contact element received in a pair of apertures.

11. A keyboard system according to claim 10 in which the generally U-shaped elements are composed of round wire, the inner contact wire having a smaller diameter than the outer contact wire.

* * * * *